US007585208B2

(12) United States Patent
Rosales Vizueta

(10) Patent No.: US 7,585,208 B2
(45) Date of Patent: Sep. 8, 2009

(54) BAFFLE PLATE ASSEMBLY FOR DIRECTING AIR FLOW IN A CARGO CONTAINER

(75) Inventor: Jose Luis Rosales Vizueta, Guayas (EC)

(73) Assignee: Dole Food Company, Inc., Westlake Village, CA (US)

( * ) Notice: Subject to any disclaimer, the term of this patent is extended or adjusted under 35 U.S.C. 154(b) by 229 days.

(21) Appl. No.: 11/705,890

(22) Filed: Feb. 13, 2007

(65) Prior Publication Data

US 2008/0194192 A1 Aug. 14, 2008

(51) Int. Cl.
*B60H 1/00* (2006.01)
*B60P 3/20* (2006.01)

(52) U.S. Cl. ..... 454/118; 454/88; 454/90; 454/91; 454/92

(58) Field of Classification Search ..... 454/88, 454/89, 90, 91, 92, 118; 296/24.35
See application file for complete search history.

(56) References Cited

U.S. PATENT DOCUMENTS

| | | | | | |
|---|---|---|---|---|---|
| 897,424 | A * | 9/1908 | Stewart | 454/91 |
| 2,040,296 | A * | 5/1936 | Cornwell | 62/418 |
| 2,070,044 | A * | 2/1937 | Gilpin | 62/387 |
| 2,324,749 | A * | 7/1943 | Wieden | 62/328 |
| 3,453,839 | A * | 7/1969 | Sabin | 62/239 |
| 3,490,352 | A | 1/1970 | Oehlschlaeger | |
| 5,042,266 | A * | 8/1991 | Yamashita et al. | 62/271 |
| 5,067,278 | A * | 11/1991 | Lyons | 49/463 |
| 5,490,395 | A | 2/1996 | Williams et al. | |
| 5,946,933 | A | 9/1999 | Clarke et al. | |
| 6,478,669 | B1 | 11/2002 | Van | |
| 7,094,145 | B2 | 8/2006 | Rye et al. | |
| 2005/0134066 | A1 * | 6/2005 | Milenovich | 296/24.33 |

FOREIGN PATENT DOCUMENTS

JP 09217979 A * 8/1997

* cited by examiner

*Primary Examiner*—Steven B McAllister
*Assistant Examiner*—Patrick F. O'Reilly, III
(74) *Attorney, Agent, or Firm*—Morrison & Foerster LLP

(57) ABSTRACT

A cargo container has a top, bottom, and sides. The cargo container includes a ventilation unit having an air outlet. The cargo container also includes a ventilated floor, which has an air channel, and a baffle plate assembly configured to direct air from the air outlet of the ventilation unit into the air channel of the ventilated floor. The baffle plate assembly includes a first plate, which is attached to the bottom of the cargo container to remain fixed, and a second plate, which is hinged to the first plate to move from an open position to a closed position. When the second plate is in the open position, a gap between the air outlet of the ventilation unit and the air channel of the ventilated floor is exposed. When the second plate is in the closed position, the gap between the air outlet of the ventilation unit and the air channel of the ventilated floor is covered.

14 Claims, 7 Drawing Sheets

BAFFLE PLATE ASSEMBLY FOR DIRECTING AIR FLOW IN A CARGO CONTAINER

BACKGROUND

1. Field

The present application relates to cargo containers, and, more particularly, to a baffle plate assembly for directing air flow in a cargo container.

2. Description of the Related Art

Cargo containers are used to transport various types of cargo, including fresh produce, over long distances. In a conventional cargo container, a ventilation unit is used to circulate air within the cargo container. A ventilated floor is also used to help circulate the air within the cargo container. In a conventional cargo container, a baffle is used to direct air from the ventilation unit into the ventilated floor through a gap between the ventilation unit and the ventilated floor. The baffle is mounted to the ventilation unit and has a lip portion that rests on the ventilated floor when the baffle covers the gap between the ventilation unit and the ventilated floor. The lip portion of the baffle, however, tends to get damaged when the cargo is loaded into the cargo container. Also, the baffle must be raised and held in order to clean the gap between the ventilation unit and the ventilated floor.

SUMMARY

In one exemplary embodiment, a cargo container has a top, bottom, and sides. The cargo container includes a ventilation unit having an air outlet. The cargo container also includes a ventilated floor, which has an air channel, and a baffle plate assembly configured to direct air from the air outlet of the ventilation unit into the air channel of the ventilated floor. The baffle plate assembly includes a first plate, which is attached to the bottom of the cargo container to remain fixed, and a second plate, which is hinged to the first plate to move from an open position to a closed position. When the second plate is in the open position, a gap between the air outlet of the ventilation unit and the air channel of the ventilated floor is exposed. When the second plate is in the closed position, the gap between the air outlet of the ventilation unit and the air channel of the ventilated floor is covered.

DETAILED DESCRIPTION

To provide a more thorough understanding of the present invention, the following description sets forth numerous specific details, such as specific configurations, parameters, examples, and the like. It should be recognized, however, that such description is not intended as a limitation on the scope of the present invention, but is intended to provide a better description of the exemplary embodiments.

Figure 1A:
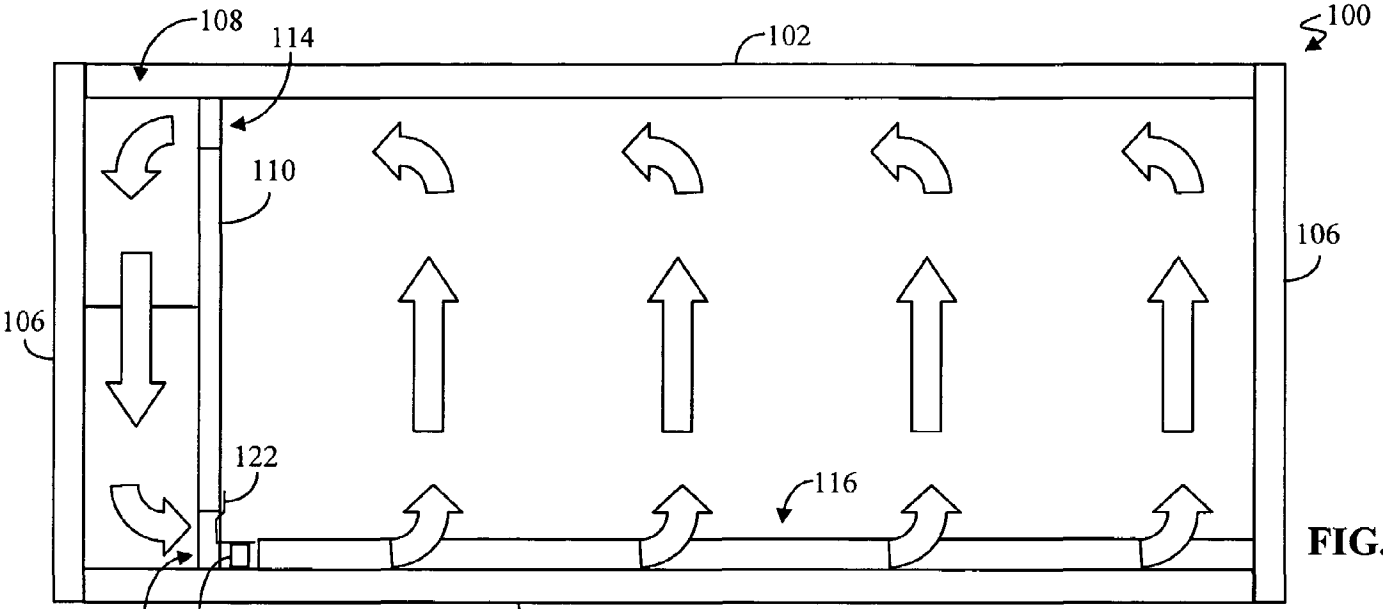
FIG. 1A illustrates a side view of a cross section of an exemplary cargo container.
Figure 1B:
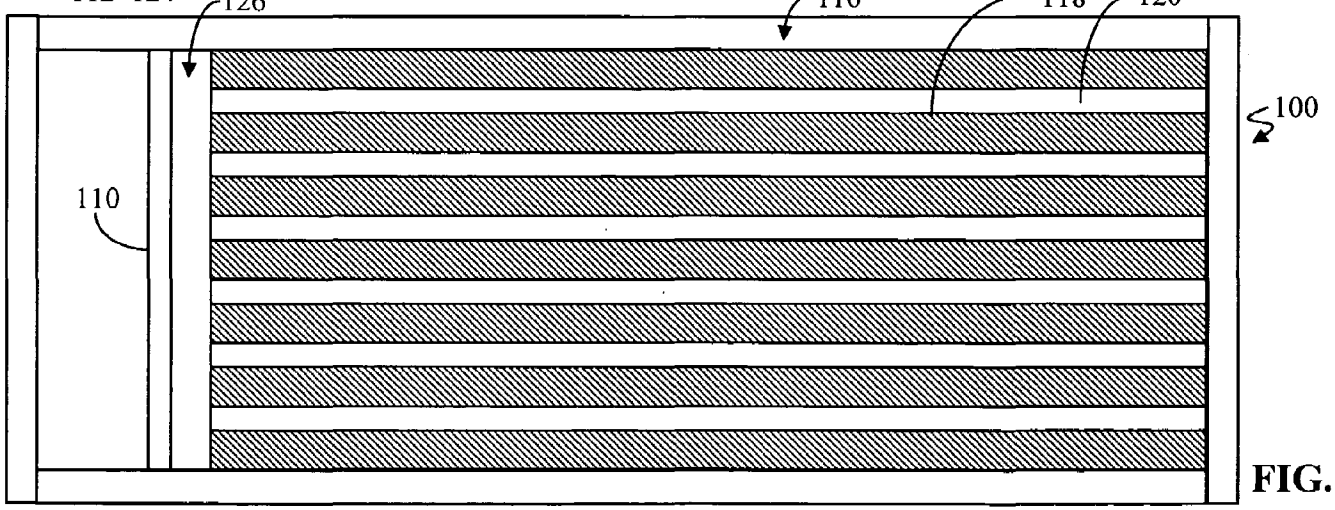
FIG. 1B illustrates a top view of a cross section of the exemplary cargo container depicted in FIG. 1A.

With reference to FIGS. 1A and 1B, an exemplary cargo container 100 is depicted. Cargo container 100 includes a top 102, bottom 104, and sides 106. Cargo container 100 can be used to ship various types of cargo, including fresh produce. For example, boxes of fresh produce can be loaded into cargo container 100 then shipped on land, by sea, and/or by rail without having to unload cargo container 100.

In one exemplary embodiment, cargo container 100 includes a ventilation unit 108 to circulate air within cargo container 100. As depicted in FIG. 1A, ventilation unit 108 can be located at one side 106 of cargo container 100. In the present exemplary embodiment, ventilation unit 108 includes a bulkhead 110 with an air outlet 112 and air inlet 114. Bulkhead 110 separates the volume of air within ventilation unit 108 from the volume of air within the remaining portions of cargo container 100. Air enters ventilation unit 108 from the remaining portion of cargo container 100 through air inlet 114. Air exits ventilation unit 108 into the remaining portion of cargo container 100 through air outlet 112.

For some types of cargo, such as fresh produce, it is desirable to refrigerate cargo container 100. Thus, ventilation unit 108 can include a refrigeration unit, including a compressor and fan, to cool the air circulated in cargo container 100. Also, for some types of cargo, such as certain types of fresh produce, it is desirable to circulate a ripening agent, such as ethylene gas. The ripening agent can be introduced at ventilation unit 108 to circulate the ripening agent within cargo container 100. Thus, while the present application may refer to air being circulated within cargo container 100, it should be recognized that various types of gases, mixtures of gases, and/or mixture of gas and air can be circulated within cargo container 100.

Figure 2:
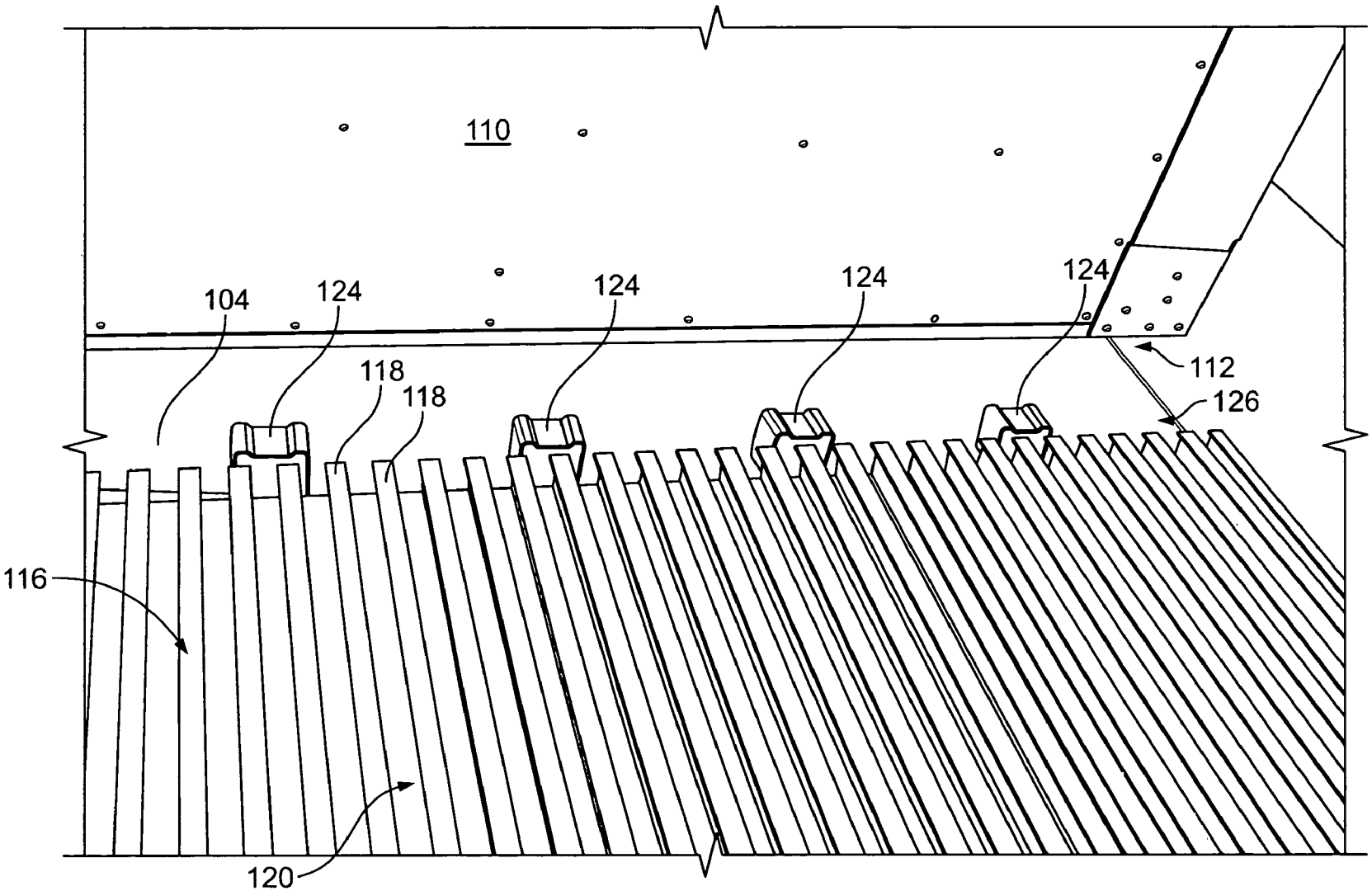
FIG. 2 illustrates a portion of the exemplary cargo container depicted in FIG. 1A.

As depicted in FIGS. 1A and 1B, cargo container 100 includes a ventilated floor 116 with air channels 120, which allow cargo to be loaded into cargo container 100, yet still allow air to be circulated within cargo container 100. In the present exemplary embodiment, cargo container 100 is depicted with ventilated floor 116 being a T-floor. As depicted in FIGS. 1B and 2, ventilated floor 116 includes T-shaped beams 118 that are spaced apart to create air channels 120. When boxes are stacked on top of ventilated floor 116, beams 118 support the boxes, while the bottoms of the boxes seal the tops of air channels 120. Thus, as depicted in FIGS. 1A and 1B, air can travel down along the length of cargo container 100 through air channels 120. As air travels through air channels 120, air can travel up through the boxes stacked on top of ventilated floor 116. It should be recognized that ventilated floor 116 can be various types of ventilated floors, such as raised panels with air holes.

As depicted in FIGS. 1B and 2, a gap 126 exists between air outlet 112 of ventilation unit 108 (FIG. 1A) and air channels 120 of ventilated floor 116. As depicted in FIGS. 1A and 1B, in the present exemplary embodiment, cargo container 100 includes a baffle plate assembly 122 that covers gap 126. Baffle plate assembly 122 directs air from air outlet 112 of ventilation unit 108 into air channels 120 of ventilated floor 116.

As depicted in FIG. 1A, baffle plate assembly 122 is attached to bottom 104 of cargo container 100 at a location that is upstream of the ventilated floor 116 in the direction of airflow. In particular, baffle plate assembly 122 is attached to a support 124, which is attached to bottom 104 of cargo container 100. With reference to FIG. 2, a plurality of supports 124 can be spaced apart across the width of gap 126. Each support 124 can be fixed to bottom 104 of cargo container 100. For example, each support 124 can be welded to bottom 104 of cargo container 100. Alternatively, each support 124 can be attached to bottom 104 of cargo container 100 using various types of fasteners. With reference again to FIG. 1A, baffle plate assembly 122 can then be attached to support (s) 124.

Figure 3:
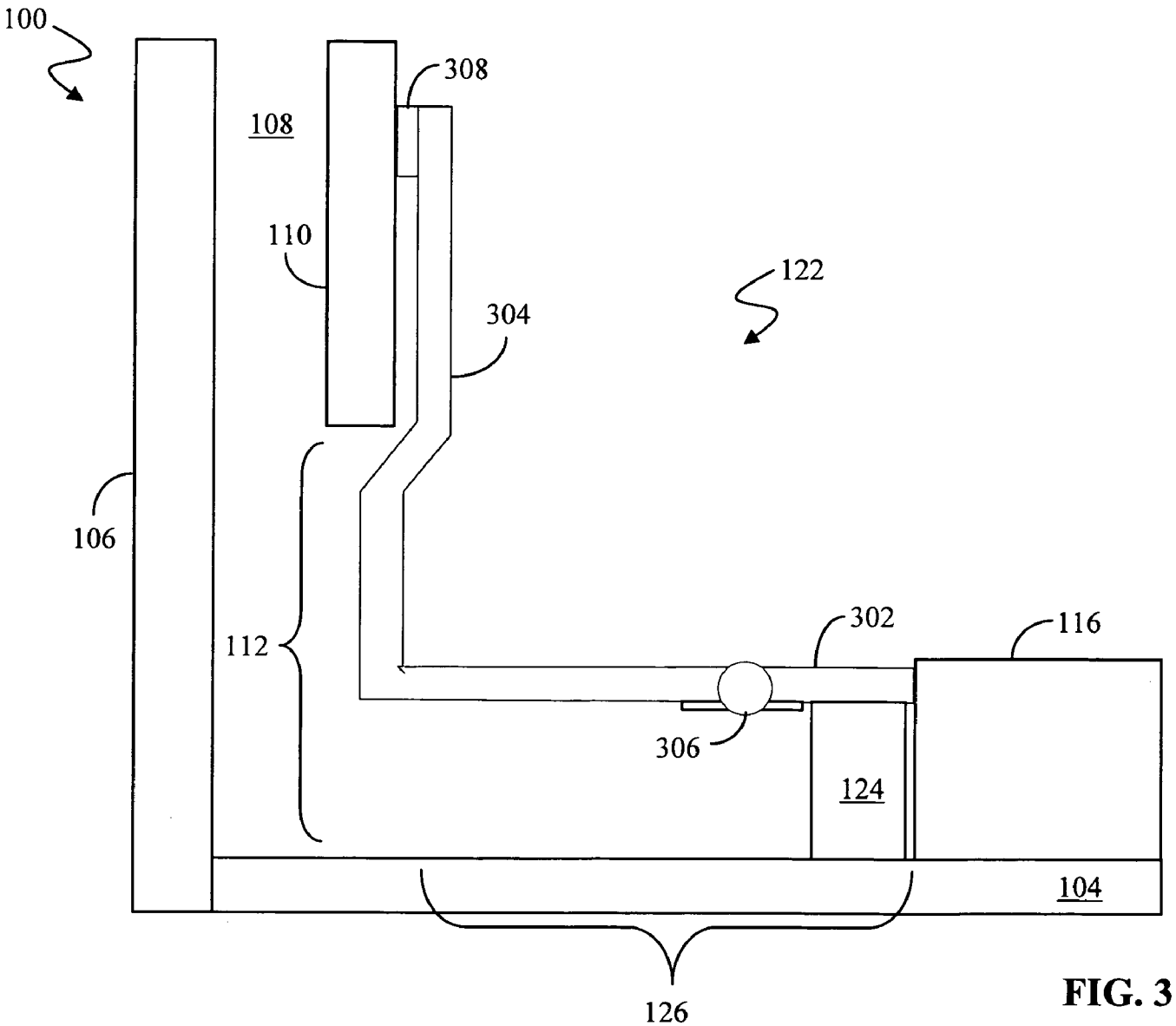
FIG. 3 illustrates a side view of a cross-section of a baffle plate assembly in a closed position.

With reference to FIG. 3, in the present exemplary embodiment, baffle plate assembly 122 includes a first plate 302 and a second plate 304. First plate 302 is attached to bottom 104 of cargo container 100 to remain fixed. In particular, first plate 302 is attached to support 124, which is attached to bottom 104 of cargo container 100. For example, first plate 302 can be riveted to support 124. As depicted in FIG. 3, the top of first plate 302 is at the same level or below the level of the top of ventilated floor 116. Thus, first plate 302 is less susceptible to being damaged when boxes are loaded onto ventilated floor 116. As well as being more resistant to damage, the baffle plate assembly 122 provides lateral resistance to protect the bulkhead 110 and ventilation unit 108 from damage that may be caused by loading boxes onto the ventilated floor 116. Furthermore, lateral resistance by the baffle plate assembly 122 can be improved by modifying the hinge 306 or adding vertical supports under plate 304.

Figure 4:
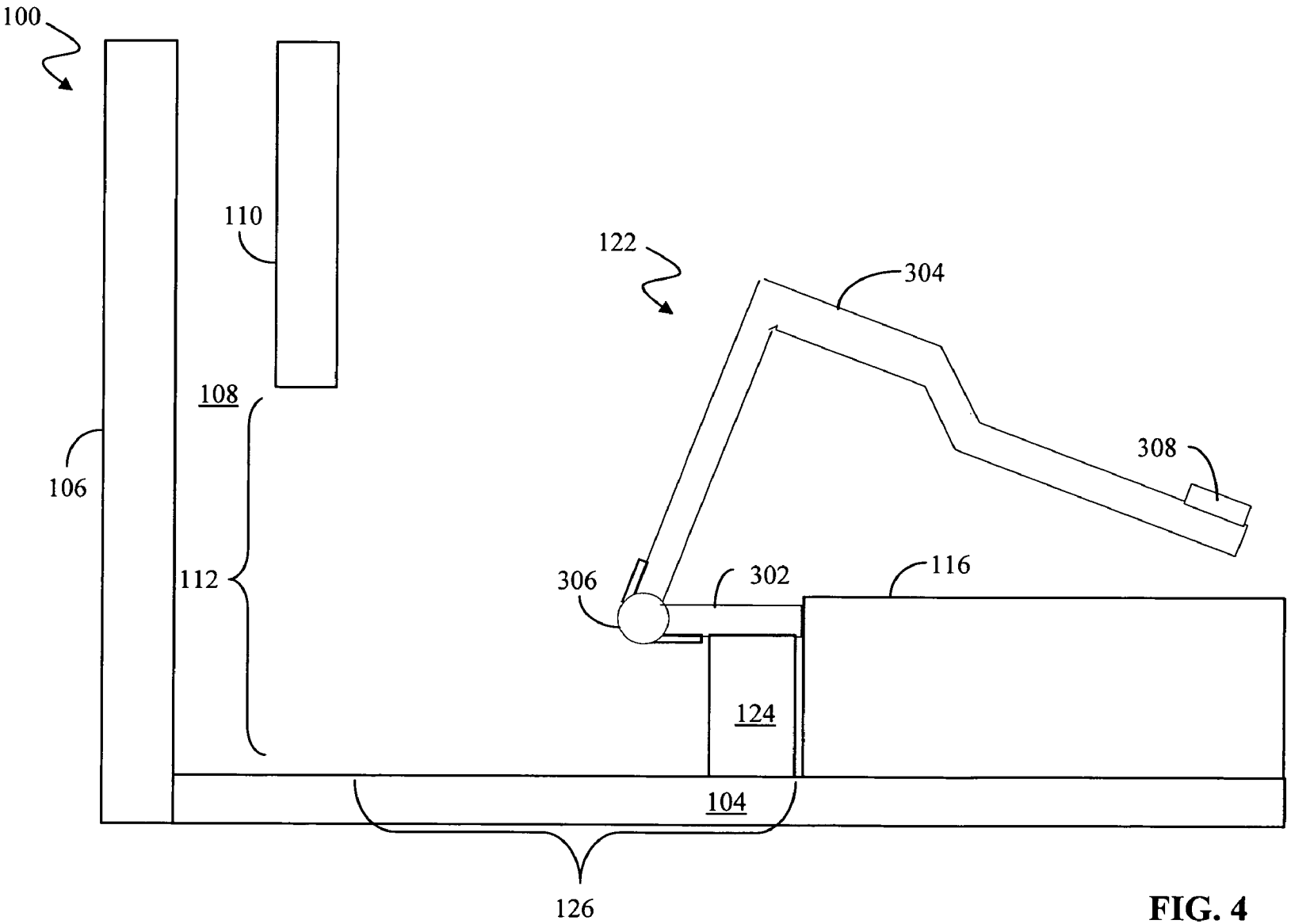
FIG. 4 illustrates a side view of a cross-section of the baffle plate assembly depicted in FIG. 3 in an open position.
Figure 5:
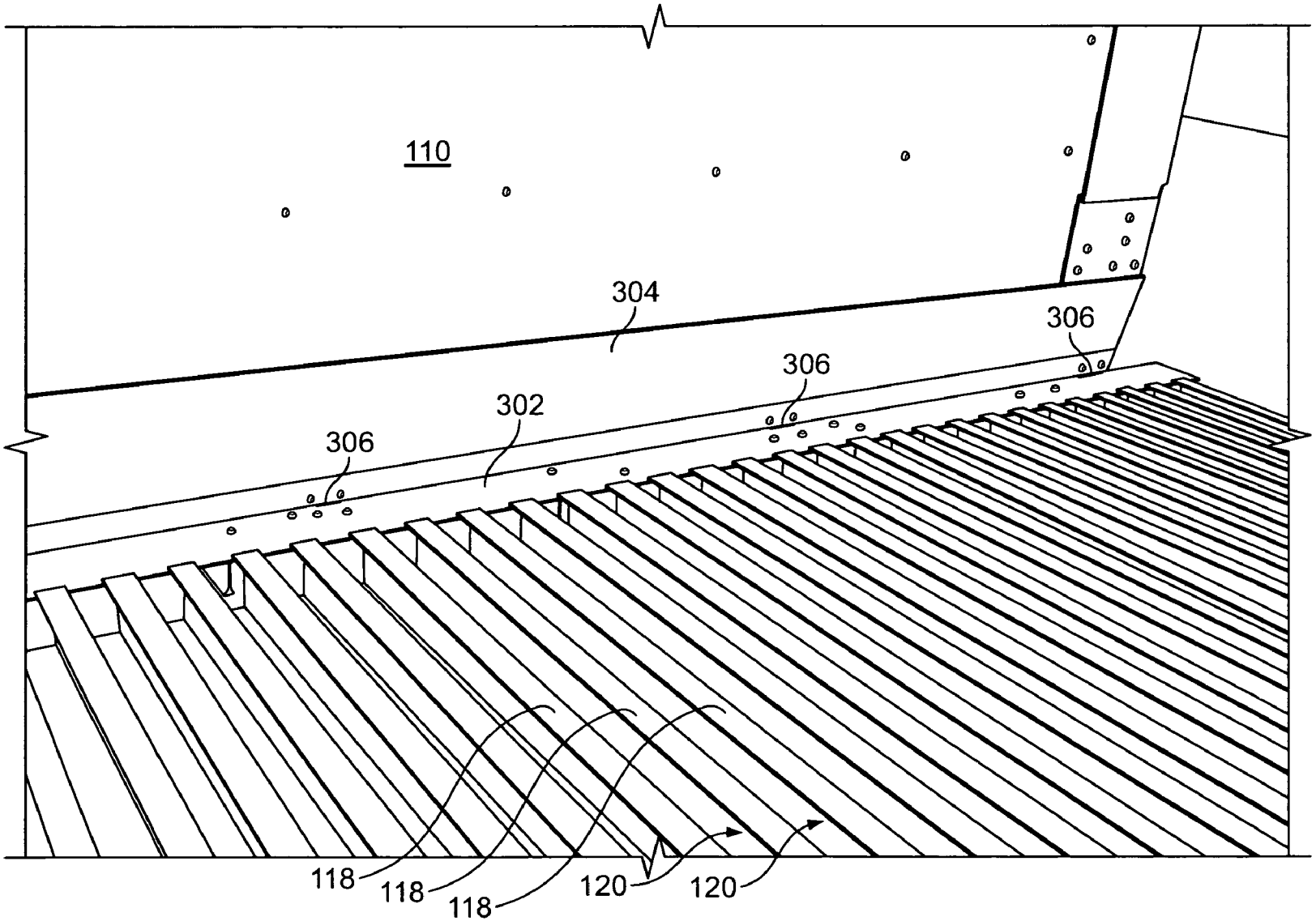
FIG. 5 illustrates the baffle plate assembly depicted in FIG. 3 in the closed position.

As illustrated by FIGS. 3 and 4, second plate 304 is hinged to first plate 302 to move from an open position to a closed position. In particular, second plate 304 and first plate 302 can be hinged together using hinge 306. As depicted in FIG. 5, second plate 304 and first plate 302 can be hinged together using a set of hinges 306 spaced apart along abutting edges of second plate 304 and first plate 302.

In an exemplary embodiment, the baffle plate assembly 122 extends 227 cm, the length of side 106. First plate 302 has a width of 5 cm and second plate has a height of 16 cm. The first plate 302 and the second plate 304 both have a thickness of 3 mm. First plate 302 is hinged to second plate 304 with three hinges 6 cm long.

In FIG. 3, second plate 304 is depicted in the closed position in which gap 126 between air outlet 112 and air channels 120 (FIG. 1B) is closed. As depicted in FIG. 3, second plate 304 is bent to have a portion that is substantially horizontal and a portion that is substantially vertical when second plate 304 is in the closed position. Second plate 304 also includes another bend along the substantially vertical portion, which better conforms the shape of second plate 304 to air outlet 112 and bulkhead 110. As depicted in FIG. 3, second plate 304 contacts bulkhead 110 when second plate 304 is in the closed position. In the present exemplary embodiment, second plate 304 includes a gasket 308 disposed along an edge of second plate 304. Gasket 308 contacts bulkhead 110 when second plate 304 is in the closed position to create a better seal between second plate 304 and bulkhead 110.

Figure 6:
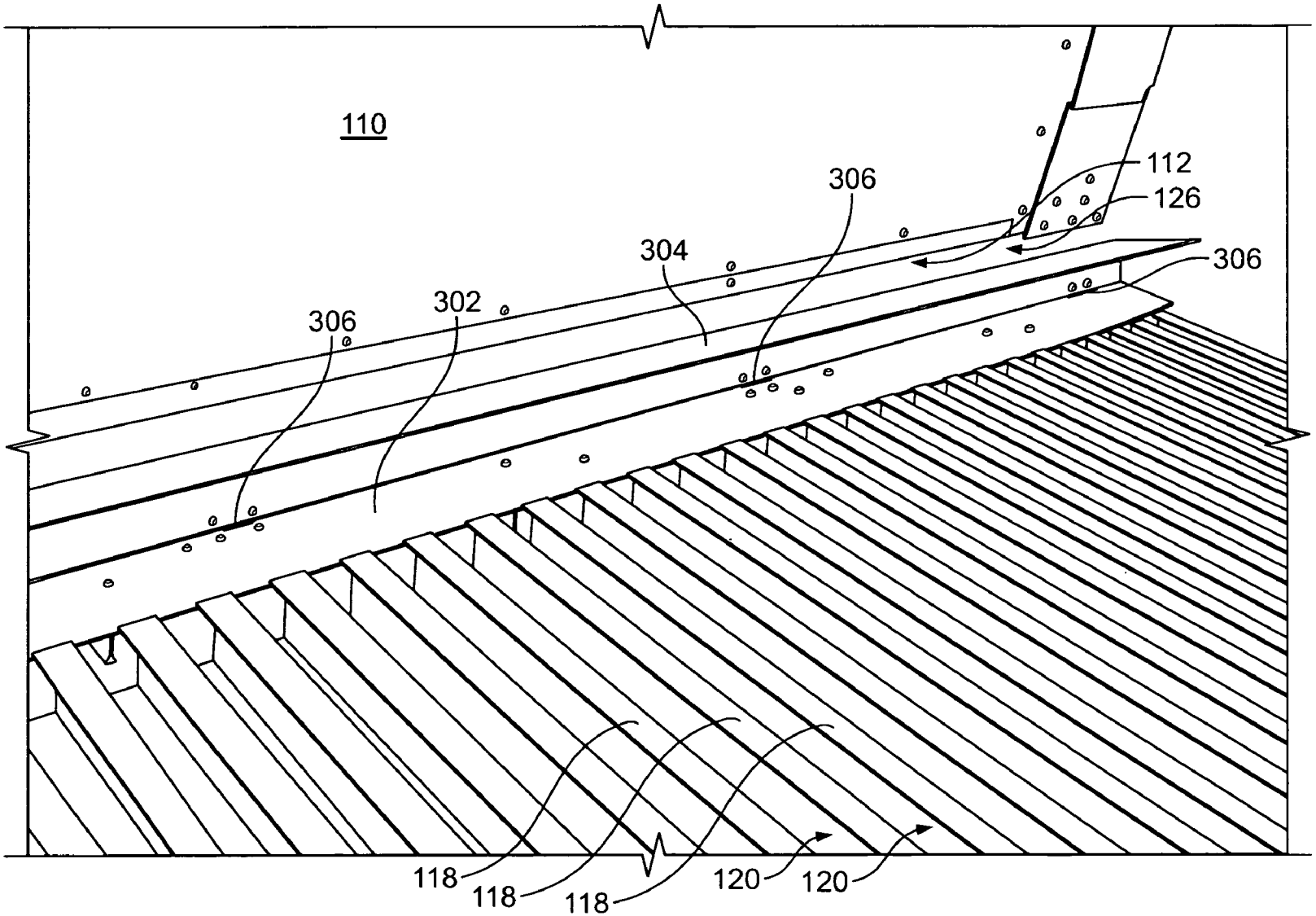
FIG. 6 illustrates the baffle plate assembly depicted in FIG. 3 moving from the closed position to the open position.
Figure 7:
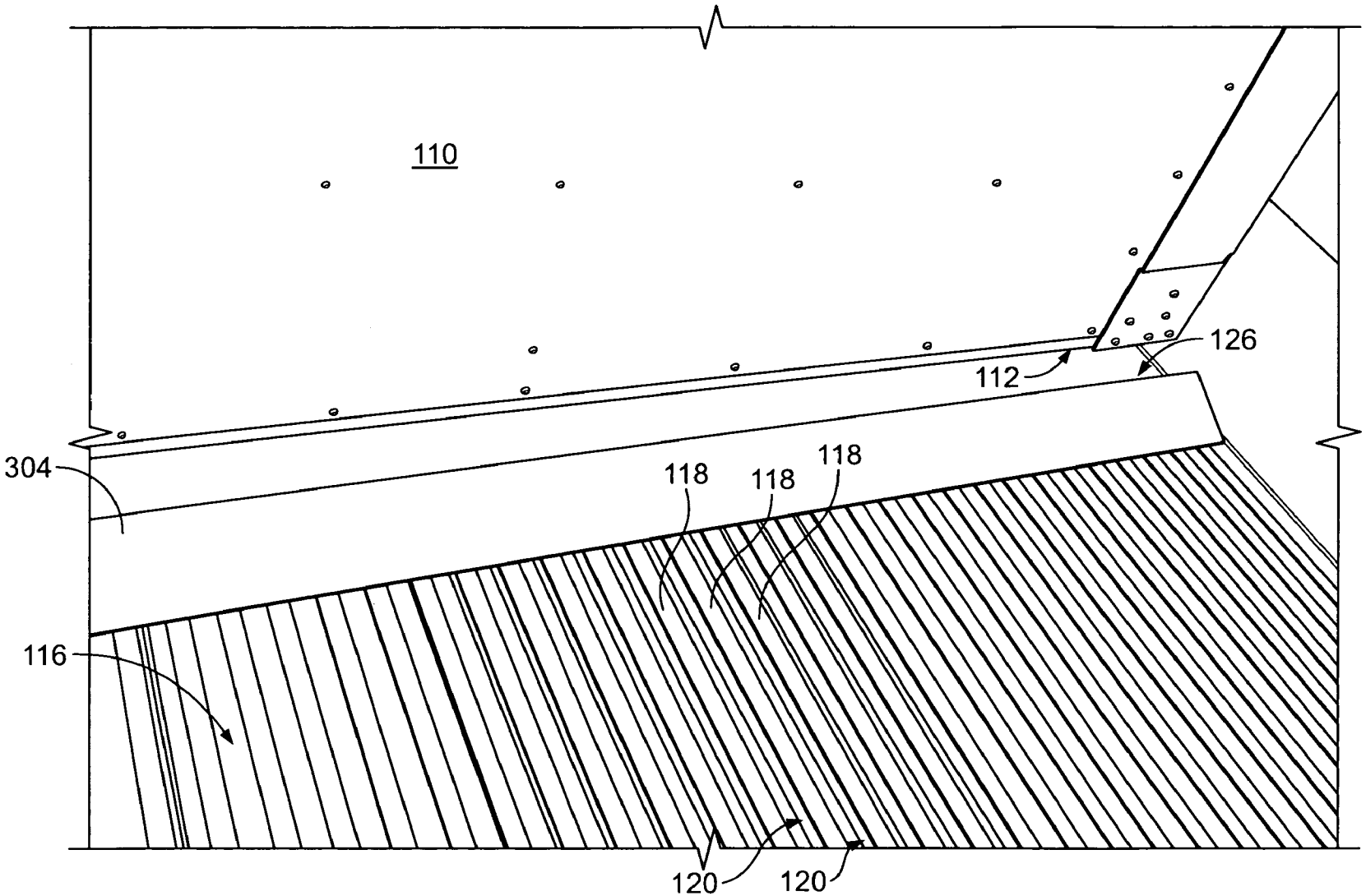
FIG. 7 illustrates the baffle plate assembly depicted in FIG. 3 in the open position.

In FIG. 4, second plate 304 is depicted in the open position in which gap 126 is exposed. In particular, FIG. 6 depicts second plate 304 being moved from the closed position to the open position. FIG. 7 depicts second plate 304 in the open position. As depicted in FIG. 7, when second plate 304 is in the open position, gap 126 is completely exposed, which makes it easier to gain access to gap 126, such as to clean gap 126. Second plate 304 can rest upon ventilated floor 116 when in the open position. Thus, second plate 304 does not need to be held in the open position in order to gain access to gap 126.

With reference to FIG. 3, thus far, baffle plate assembly 122 has been depicted and described as an integral component of cargo container 100. It should be recognized, however, that baffle plate assembly 122 can be provided as a separate component to be installed in cargo container 100. For example, baffle plate assembly 122 can be provided to be installed into a newly constructed cargo container 100. Alternatively, baffle plate assembly 122 can be provided to be retrofitted into an existing cargo container 100.

In particular, baffle plate assembly 122 can be obtained with first plate 302 and second plate 304 hinged together with hinge 306. First plate 302 can then be attached to bottom 104 of cargo container 100. In particular, supports 124 can be first attached to bottom 104 of cargo container 100. First plate 302 can then be attached to supports 124.

Although the present invention has been described with respect to certain exemplary embodiments, examples, and applications, it will be apparent to those skilled in the art that various modifications and changes may be made without departing from the invention.

I claim:

1. A cargo container having a top, bottom, and sides, the cargo container comprising:

a ventilation unit including a bulkhead, a top air inlet, and a bottom air outlet;

a ventilated floor in the cargo container having an air channel;

a baffle plate assembly configured to direct an airflow from the air outlet of the ventilation unit into the air channel of the ventilated floor, wherein the baffle plate assembly is located upstream of the ventilated floor in the direction of airflow, and wherein the baffle plate assembly comprises:

a first plate attached to the bottom of the cargo container to remain fixed; and a second plate hinged to the first plate to move from an open position to a closed position, wherein the second plate pivots away from the bulkhead to move from the closed position to the open position, such that to remain in the open position, the second plate does not need to be held open, wherein a gap between the bottom air outlet of the ventilation unit and the air channel of the ventilated floor is exposed when the second plate is in the open position, and wherein the gap between the bottom air outlet of the ventilation unit and the air channel of the ventilated floor is covered when the second plate is in the closed position.

2. The cargo container of claim 1, wherein the bottom air outlet is disposed at a bottom portion of the bulkhead near the ventilated floor.

3. The cargo container of claim 2, wherein the second plate contacts the bulkhead when the second plate is in the closed position.

4. The cargo container of claim 3, wherein the second plate includes a gasket disposed along an edge of the second plate, wherein the gasket contacts the bulkhead when the second plate is in the closed position.

5. The cargo container of claim 1, further comprising:

a plurality of supports attached to the bottom of the cargo container, wherein the plurality of supports are distributed in the gap between the bottom air outlet of the ventilation unit and the air channel of the ventilated floor, and wherein the first plate is attached to the plurality of supports.

6. The cargo container of claim 1, wherein the second plate is positioned over the first plate when the second plate is in the open position.

7. The cargo container of claim 1, wherein the ventilated floor comprises:

a plurality of beams, wherein the air channel is defined between the beams of the ventilated floor.

8. The cargo container of claim 1, wherein the baffle plate assembly further comprises:

a plurality of hinges attached to the first plate and the second plate.

9. The cargo container of claim 1, wherein the second plate is bent to have a first portion and a second portion, and wherein the first portion is substantially horizontal and the second portion is substantially vertical when the second plate is in the closed position.

10. A baffle plate assembly for use in a cargo container having a top, bottom, and sides, the cargo container having a ventilation unit and a ventilated floor, wherein the ventilation unit includes a bulkhead, a top air inlet and a bottom air outlet, the baffle plate assembly comprising:

a first plate configured to be attached to the bottom of the cargo container to remain fixed; and a second plate hinged to the first plate to move from an open position to a closed position, wherein the second plate pivots away from the bulkhead to move from the closed position to the open position, such that to remain in the open position, the second plate does not need to be held open, wherein a gap between the bottom air outlet of the ventilation unit and an air channel of the ventilated floor is exposed when the second plate is in the open position, and wherein the gap between the bottom air outlet of the ventilation unit and the air channel of the ventilated floor is covered when the second plate is in the closed position to direct an airflow from the bottom air outlet of the ventilation unit into the air channel of the ventilated floor, and wherein the baffle plate assembly is located upstream of the ventilated floor in the direction of airflow.

11. The baffle plate assembly of claim 10, further comprising:

a plurality of supports attached to the bottom of the cargo container, wherein the first plate is attached to the plurality of supports.

12. The baffle plate assembly of claim 10, wherein the second plate is bent to have a first portion and a second portion, and wherein the first portion is substantially horizontal and the second portion is substantially vertical when the second plate is in the closed position.

13. A method of installing a baffle plate assembly in a cargo container having a top, bottom, and sides, the cargo container having a ventilation unit and a ventilated floor, wherein the ventilated unit includes a bulkhead, a top air inlet, and a bottom air outlet the method comprising:

obtaining the baffle plate assembly, the baffle plate assembly having a first plate, and a second plate hinged to the first plate to move from an open position to a closed position, wherein the second plate pivots away from the bulkhead to move from the closed position to the open position such that to remain in the open position, the second plate does not need to be held open; and attaching the first plate to the bottom of the cargo container to remain fixed, wherein the baffle plate assembly is located upstream of the ventilated floor in the direction of airflow after the baffle plate assembly is installed, wherein a gap between the bottom air outlet of the ventilation unit and an air channel of the ventilated floor is exposed when the second plate is in the open position after the baffle plate assembly is installed, and wherein the gap between the bottom air outlet of the ventilation unit and the air channel of the ventilated floor is covered when the second plate is in the closed position to direct an airflow from the bottom air outlet of the ventilation unit into the air channel of the ventilated floor after the baffle plate assembly is installed.

14. The method of claim 13, wherein attaching the first plate to the bottom of the cargo container comprises:

attaching a plurality of supports to the bottom of the cargo container; and attaching the first plate to the plurality of supports.

* * * * *

UNITED STATES PATENT AND TRADEMARK OFFICE

CERTIFICATE OF CORRECTION

PATENT NO. : 7,585,208 B2
APPLICATION NO. : 11/705890
DATED : September 8, 2009
INVENTOR(S) : Jose L. Rosales Vizueta It is certified that error appears in the above-identified patent and that said Letters Patent is hereby corrected as shown below:

In the Claims:

Column 5, Claim 10, Line 17, delete "inlet" and insert -- inlet, --.

Column 6, Claim 13, Line 10, delete "outlet" and insert -- outlet, --.

Column 6, Claim 13, Line 18, delete "position" and insert -- position, --. (second occurrence)

Column 6, Claim 13, Line 32, delete "an" and insert -- the --.

Signed and Sealed this

First Day of December, 2009

David J. Kappos

David J. Kappos
*Director of the United States Patent and Trademark Office*